US011272588B2

(12) United States Patent
Zou et al.

(10) Patent No.: US 11,272,588 B2
(45) Date of Patent: Mar. 8, 2022

(54) DIMMING SIGNAL PROCESSING CIRCUIT HAVING MULTIPLE FUNCTIONS

(71) Applicant: SHENZHEN SOSEN ELECTRONICS CO., LTD, Guangdong (CN)

(72) Inventors: Chaoyang Zou, Guangdong (CN); Song Pan, Guangdong (CN)

(73) Assignee: SHENZHEN SOSEN ELECTRONICS CO., LTD, Shenzhen (CN)

( * ) Notice: Subject to any disclaimer, the term of this patent is extended or adjusted under 35 U.S.C. 154(b) by 0 days.

(21) Appl. No.: 17/285,089

(22) PCT Filed: Mar. 28, 2019

(86) PCT No.: PCT/CN2019/080243
§ 371 (c)(1),
(2) Date: Apr. 13, 2021

(87) PCT Pub. No.: WO2020/077953
PCT Pub. Date: Apr. 23, 2020

(65) Prior Publication Data

US 2021/0368596 A1 Nov. 25, 2021

(30) Foreign Application Priority Data

Oct. 15, 2018 (CN) ..... 201811195446.9

(51) Int. Cl.
*H05B 45/10* (2020.01)
*H05B 45/325* (2020.01)

(52) U.S. Cl.
CPC ..... *H05B 45/10* (2020.01); *H05B 45/325* (2020.01)

(58) Field of Classification Search
CPC ..... H05B 45/00; H05B 45/10; H05B 45/32; H05B 454/325; H05B 47/00
See application file for complete search history.

(56) References Cited

U.S. PATENT DOCUMENTS

2013/0334980 A1* 12/2013 Zhou ..... H05B 47/185 315/250

FOREIGN PATENT DOCUMENTS

CN 201742625 U 2/2011
CN 203912254 U 10/2014

OTHER PUBLICATIONS

International Search Report of PCT Patent Application No. PCT/CN2019/080243 dated Jul. 15, 2019.

* cited by examiner

*Primary Examiner* — Jimmy T Vu

(57) ABSTRACT

A dimming signal processing circuit having multiple functions includes a dimming signal input terminal and a dimming signal output terminal, and further includes an input signal processing circuit, a modulation circuit, an isolation circuit and an output shaping circuit connected in cascade to the dimming signal input terminal, and an oscillation signal output circuit connected to the modulation circuit, wherein the output shaping circuit comprises a plurality of signal output circuits connected to the dimming signal output terminal respectively. The dimming signal processing circuit having multiple functions is low in cost and high in practicability, and meets new laws and regulations and more use requirements.

13 Claims, 3 Drawing Sheets

DIMMING SIGNAL PROCESSING CIRCUIT HAVING MULTIPLE FUNCTIONS

BACKGROUND OF THE INVENTION

1. Technical Field

The present invention relates to dimming circuits, and more particularly relates to a dimming signal processing circuit having multiple functions.

2. Description of Related Art

LED lighting systems on the present lighting market are used on most lighting occasions due to their outstanding advantages of high luminous efficiency, high stability, long service life, low energy consumption, flexible configuration, etc., they are developing vigorously, and will finally satisfy all indoor and outdoor lighting requirements.

During LED lighting applications, with the expansion of the market scale, the lighting systems are being developed towards automation and intelligent control, and dimmable light sources according to different environments and user requirements are booming to be developed.

Existing dimming techniques typically include: a thyristor being controlled at the input terminal to realize stepless dimming; three segments (more segments) being controlled at the input terminal to realize stepped dimming; an analog voltage (generally 0-10V) being controlled at the input terminal to realize stepless dimming; a variable resistor being controlled at the output terminal to realize dimming; a pulse waveform signal with a variable duty cycle being controlled at the output terminal to realize dimming. Of all these dimming methods, a dimming signal needs to be electrically connected to the input terminal or the output terminal of an LED constant-current driving power supply, and the risk of electric shocks may be caused during actual application because manual operation is needed for dimming operation, which cannot meet the latest safety standard UL8750. In addition, of all these existing dimming methods, regardless of whether there is a thyristor dimming or multi-segment dimming control at the input terminal or dimming and all-in-one dimming controlled at the output terminal, the dimming signal processing part is electrically connected to the input terminal or the output terminal of the LED constant-current driving power supply, so potential safety hazards may occur in the manual operation process. Moreover, existing dimming products have been forbidden in some regions. Thus, it is urgently needed to develop an insulated and isolated dimming signal processing circuit module to meet more requirements.

BRIEF SUMMARY OF THE INVENTION

The technical issue to be settled by the invention is to overcome the defects mentioned in the description of the related art by providing a dimming signal processing circuit having multiple functions.

The technical solution adopted by the invention to settle the aforesaid technical issue is as follows: a dimming signal processing circuit having multiple functions comprises a dimming signal input terminal and a dimming signal output terminal, and further comprises: an input signal processing circuit, a modulation circuit, an isolation circuit and an output shaping circuit connected in cascade to the dimming signal input terminal, and an oscillation signal output circuit connected to the modulation circuit, wherein the output shaping circuit comprises a plurality of signal output circuits separately connected to the dimming signal output terminal.

Preferably, the input signal processing circuit comprises an integral follower circuit, an attenuation circuit and a constant current source, wherein:

The integral follower circuit is connected to the dimming signal input terminal, is used, when a dimming signal input to the dimming signal input terminal is a PWM signal, for operating the PWM signal to obtain a first voltage signal meeting a preset condition, or is used, when an analog DC voltage dimming signal is accessed to the dimming signal input terminal, for generating a third voltage signal;

The constant current source is connected to the dimming signal input terminal and is used, when the dimming signal input terminal is connected to an adjustable resistor, for generating a second voltage signal, meeting the preset condition, at an output terminal of the integral follower circuit;

The attenuation circuit is connected to the integral follower circuit and is configured for attenuating the first voltage signal, the second voltage signal or the third voltage signal.

Preferably, the constant current source comprises a voltage reference chip U4, a triode Q2, a triode Q1, a resistor R9, a resistor R10 and zener diode ZD1, wherein a sampling terminal of the voltage reference chip U4 is connected to a cathode of the voltage reference chip U4 and is then connected to a power supply VCC, an anode of the voltage reference chip U4 is connected to an emitter of the triode Q1, a base of the triode Q1 is connected to a collector of the triode Q1 and is grounded through the resistor R10, the base of the triode Q1 is connected to a base of the triode Q2, an emitter of the triode Q2 is connected to the power supply VCC through the resistor R9, a collector of the triode Q2 is connected to the dimming signal input terminal and a negative electrode of the zener diode ZD1, and a positive electrode of the zener diode ZD1 is grounded; and/or The attenuation circuit comprises a resistor R12 and a resistor R13, the resistor R12 has a terminal connected to the integral follower circuit and another terminal connected to the modulation circuit and one terminal of the resistor R13, and the other terminal of the resistor R13 is grounded.

Preferably, the integral follower circuit comprises an integral circuit and a follower circuit.

The integral circuit comprises a resistor R11 and a capacitor C4, and the resistor R11 has a terminal connected to the dimming signal input terminal and another terminal being grounded through the capacitor C4.

The follower circuit comprises an operational amplifier U5, wherein an in-phase input terminal of the operational amplifier U5 is connected to the dimming signal input terminal through the resistor R11 and is grounded through the capacitor C4, and a reverse input terminal of the operational amplifier U5 is connected to an output terminal of the operational amplifier U5.

Preferably, the modulation circuit comprises a PWM modulation circuit; and/or

The oscillation signal output circuit comprises:

An oscillation signal generation circuit configured for generating a sawtooth signal; and A level shift circuit connected to the oscillation signal generation circuit and configured for shifting the sawtooth signal to enable a low level of the sawtooth signal to be zero.

Preferably, the PWM modulation circuit comprises a comparator U3, wherein an in-phase input terminal of the comparator U3 is connected to the oscillation signal output circuit, and a reverse input terminal of the comparator U3 is connected to the input signal processing circuit; and/or The oscillation signal generation circuit comprises a voltage reference chip U1, a comparator U2, a diode D1 and a diode D2;

A sampling terminal of the voltage reference chip U1 is connected to a cathode of the voltage reference chip U1 through a resistor R2 and is then connected to a power supply VCC through a resistor R1 and connected to the in-phase input terminal of the comparator U2 through a resistor R4, the sampling terminal of the voltage reference chip U1 is grounded through a resistor R3, and an anode of the voltage reference chip U1 is grounded;

A reverse input terminal of the comparator U2 is connected to the power supply VCC through a resistor R6 and is grounded through a capacitor C2, and the in-phase input terminal of the comparator U2 is grounded through a resistor R5;

A positive electrode of the diode D1 is connected to the in-phase input terminal of the comparator U2 through a resistor R7, and a negative electrode of the diode D1 is connected to an output terminal of the comparator U2;

A positive electrode of the diode D2 is connected to the reverse input terminal of the comparator U2 and is also connected to the level shift circuit (32), and a negative electrode of the diode D2 is connected to the output terminal of the comparator U2.

Preferably, the level shift circuit comprises a capacitor C3 and a resistor R8;

The capacitor C3 has a terminal connected to the positive electrode of the diode D2 and a terminal connected to the PWM modulation circuit;

The resistor R8 has a terminal connected to the PWM modulation circuit and a terminal being grounded.

Preferably, the isolation circuit comprises an optocoupler OT1B;

A second pin of the optocoupler OT1B is connected to an output terminal of the modulation circuit, and a fourth pin of the optocoupler OT1B is connected to the output shaping circuit.

Preferably, the plurality of signal output circuits comprise an open-drain PWM signal output, an amplitude-limiting PWM signal output and an analog voltage signal output.

Preferably,

The open-drain PWM signal output comprises an MOS transistor Q3, a gate of the MOS transistor Q3 is connected to the fourth pin of the optocoupler OT1B, and a drain of the MOS transistor Q3 is connected to the dimming signal output terminal through a switch K1;

The amplitude-limiting PWM signal output comprises an MOS transistor Q4, a gate of the MOS transistor Q4 is connected to the fourth pin of the optocoupler OT1B, and a drain of the MOS transistor Q4 is connected to the power supply VDD through a resistor R16 and is connected to the dimming signal output terminal through a switch K2;

The analog voltage signal output comprises an operational amplifier U6, an in-phase input terminal of the operational amplifier U6 is connected to a drain of the MOS transistor Q4 through a resistor R17 and is grounded through a capacitor C5, a reverse input terminal of the operational amplifier U6 is connected to an output terminal of the operational amplifier U6 and is connected to the dimming signal output terminal through a switch K3.

The dimming signal processing circuit having multiple functions has the following beneficial effects: costs are low, the practicability is high, and the requirements of new laws and regulations and more use requirements are met.

BRIEF DESCRIPTION OF THE SEVERAL VIEWS OF THE DRAWINGS

The invention will be further described below in conjunction with the accompanying drawings and embodiments. In the figures.

DETAILED DESCRIPTION OF THE INVENTION

To gain a better understanding of the technical features, purposes and effects of the invention, specific embodiments of the invention will be described in detail below with reference to the accompanying drawings.

Figure 1:
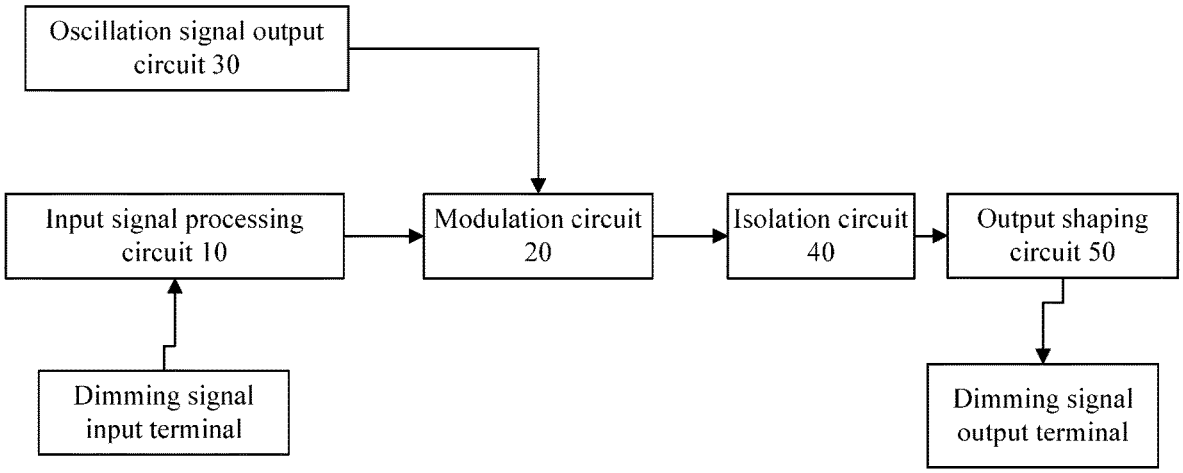
FIG. 1 is a logic block diagram of a first embodiment of a dimming signal processing circuit according to the invention.

As shown in FIG. 1, in a first embodiment of the invention, a dimming signal processing circuit having multiple functions comprises a dimming signal input terminal and a dimming signal output terminal, and further comprises: an input signal processing circuit 10, a modulation circuit 20, an isolation circuit 40, and an output shaping circuit 50 connected in cascade to the dimming signal input terminal, and an oscillation signal output circuit 30 connected to the modulation circuit 20, wherein the output shaping circuit 50 comprises a plurality of signal output circuits separately connected to the dimming signal output terminal. Specifically, a dimming signal is input via the dimming signal input terminal, is then primarily processed by the input signal processing circuit 10 and is then input to the modulation circuit 20, the modulation circuit 20 receives an oscillation signal input by the oscillation signal output circuit 30, the dimming signal is modulated to obtain a dimming input signal meeting requirements such as a pulse signal meeting requirements, then the dimming input signal is input to the isolation circuit 40, and the output shaping circuit 50 is driven to generate multiple required dimming signal outputs to match different backend circuits under the isolation and driving effect of the isolation circuit 40. It can be further understood that the input signal processing circuit 10 is configured for normalizing different input signals to obtain a normalized dimming signal input.

Figure 2:
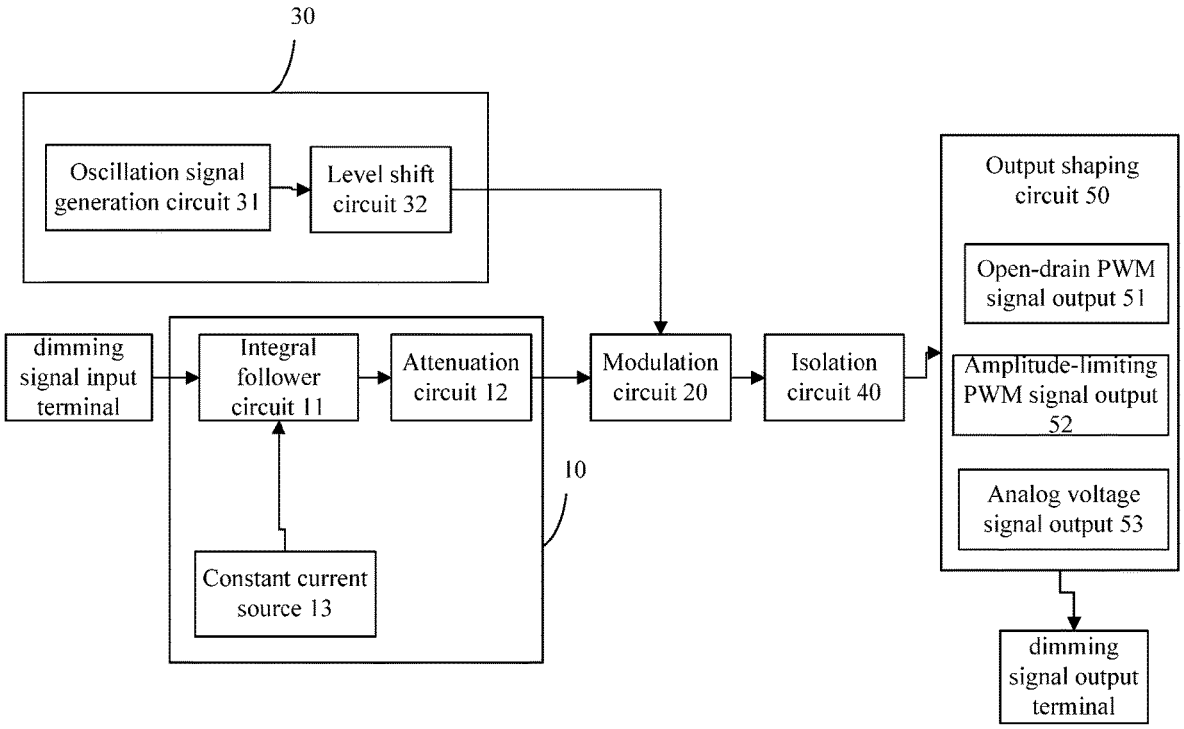
FIG. 2 is a logic block diagram of a second embodiment of the dimming signal processing circuit according to the invention.

Furthermore, as shown in FIG. 2, the input signal processing circuit 10 comprises an integral follower circuit 11, an attenuation circuit 12 and a constant-current source 13, wherein the integral follower circuit 11 is connected to the dimming signal input terminal and is used, when the dimming signal input to the dimming signal input terminal is a PWM signal, for operating the PWM signal to obtain a first voltage signal meeting a preset condition, or is used, when an analog DC voltage dimming signal is accessed to the dimming input terminal, for generating a third voltage signal; the constant current source 13 is connected to the dimming signal input terminal and is configured for generating a second voltage signal meeting the preset condition at an output terminal of the integral follower circuit 11 when the dimming signal input terminal is connected to an adjustable resistor; the attenuation circuit 12 is connected to the integral follower circuit 11 and is configured for attenuating the first voltage signal, the second voltage signal or the third voltage signal. Specifically, the integral follower circuit 11 is configured for carrying out an integral operation on the PWM signal input via the dimming signal input terminal to output a voltage signal in direct proportion to the duty cycle of the PWM signal, namely the first voltage signal, and is also configured for filtering an external analog voltage signal, so that when the analog DC voltage dimming signal is accessed to the dimming signal input terminal, the third voltage signal can be generated at the output terminal of the integral follower circuit 11; the constant current source 13 generates a constant source current to detect the external adjustable resistor to generate a voltage signal in direct proportion with the resistance, and the voltage signal passes through the integral follower circuit to generate the second voltage signal at the output terminal of the integral follower circuit; a proportional attenuation unit is configured for attenuating the normalized signal obtained by processing the first voltage signal, the second voltage signal or the third voltage signal in a certain proportion, so that the normalized signal matches the amplitude of a sawtooth signal generated by the oscillation signal output circuit 30. Several different existing dimming signal inputs will be explained by way of examples. When the PWM signal is output by the dimming signal output terminal, the amplitude of the PWM signal is defined as 10V, the duty cycle of the PWM signal is 0-100%, and the PWM signal counteracts the influence of the constant current source 13 and is processed by the integral follower circuit 11 to be converted into an analog voltage, namely the first voltage signal, which is then processed by the attenuation circuit 12 to obtain a normalized dimming signal input. It should be additionally pointed out that when a 0-10V analog voltage dimming signal is input to the dimming signal input terminal, a current output by the constant current source 13 is extremely small and is only 100 uA, so the influence of the constant current source 13 can be easily counteracted by the analog voltage and thus can be ignored, and in this case, the integral follower circuit is equivalent to a 1:1 signal follower for the analog voltage, and a required normalized dimming signal input is output by the attenuation circuit 12 after the analog voltage is followed and output. When a 0-100K adjustable resistor dimming signal is input to the dimming signal input terminal, the resistor is a passive element and will not generate any energy, so an output of the constant current source 13 will pass through the resistor; according to the Ohm's law, U=IR, wherein I is a constant value 100 uA output by the constant-current source 13, R is a 0-100K variable resistor, the output U will be a 0-10V variable DC voltage, namely the second voltage signal, the direct current may appear on any node of the variable resistor and the constant current source 13 and is processed in the same way as the processing process implemented when the dimming input signal is the 0-10V analog voltage, and finally, a normalized dimming signal input is obtained. In this way, in different application scenarios, namely under different dimming outputs, a normalized dimming signal will be input to the input terminal of the modulation signal 20 by the input signal processing circuit 10. In addition, in some cases where a resistor for dimming is not needed, the constant current source 13 can be omitted to further reduce product costs.

Furthermore, in some embodiments, the constant current source 13 comprises a voltage reference chip U4, a triode Q2, a triode Q1, a resistor R9, a resistor R10, and a zener diode ZD1, wherein a sampling terminal of the voltage reference chip U4 is connected to a cathode of the voltage reference chip U4 and is then connected to a power supply VCC, an anode of the voltage reference chip U4 is connected to an emitter of the triode Q1, a collector of the triode Q1 is connected to a base of the triode Q1 and is grounded through the resistor R10, the base of the triode Q1 is connected to a base of the triode Q2, an emitter of the triode Q2 is connected to the power supply VCC through the resistor R9, a collector of the triode Q2 is connected to the dimming signal input terminal and a negative electrode of the zener diode ZD1, and a positive electrode of the zener diode ZD1 is grounded. Specifically, a constant current circuit unit consists of a resistor R9, a resistor R10, a triode Q1, a triode Q2, a voltage reference chip U4 and a zener diode ZD1, wherein the voltage reference chip U4, the triode Q1 and the resistor R10 are connected in series and are then connected to a power supply terminal, namely the power supply VCC, a high-precision reference voltage signal is generated at two terminals of the voltage reference chip U4, and the voltage reference chip may be AZ431 capable of generating a 2.5V reference, AZ432 capable of generating a 1.25V reference or other 2.5V reference devices or 1.25V reference devices. The triode Q1 and the triode Q2 are of the same model to guarantee the symmetry. For example, to realize a better effect, packaged twin triodes can be used. The base and the collector of the triode Q1 are connected to be used as a diode. Because the polarities of the triode Q1 and the triode Q2 are extremely similar, the base-emitter property of the triode Q1 is symmetrical with the base-emitter property of the triode Q2, and the voltage-drop loss and temperature property of the triode Q1 are also extremely identical with the voltage-drop loss and temperature property of the triode Q2, so a constant current output can be obtained at the collector of the triode Q2 only by setting the resistance of the resistor R9, and the calculation formula is: the reference voltage across the two terminals of the voltage reference chip U4/the resistance of R9=the output current of the collector of Q2, for example, if the voltage reference chip U4 is AZ431, a 2.5V reference voltage can be obtained. If the resistance of the resistor R9 is set to 25K Ohm, a 0.0001 A or 100 μA current will obtained according to the formula: 2.5V/25000 Ohm=0.0001 A=100 μA, and this current may be constant. When a variable resistor is connected between the collector of the triode Q2 and the power supply terminal, a voltage signal in direct proportion with the resistance can be obtained by conversion according to the resistance of the variable resistor. When the dimming signal input terminal is suspended, the collector voltage of the triode Q2 will rise, so the zener diode ZD1 is connected in parallel between the collector of the triode Q2 and the ground, the stabilized voltage of the zener diode ZD1 can be selected as actually needed, and this voltage is defined as 10V for common interfaces. To ensure that the zener diode ZD1 has a better temperature property, a zener diode with a low stabilized voltage may be reversely connected in series to one or two common diodes, as a replacement. Because the negative temperature coefficient of the common diode, which is forward biased, is complementary with the forward temperature coefficient of the zener diode which is reversely biased, temperature drifts of the voltage stabilizing precision caused by changes of the temperature of the operating environment of the circuit can be automatically compensated. In the constant current source 13, if the precision requirement is not too high, the triode Q1 may be omitted, that is, a lower terminal of the voltage reference chip U4 is directly connected to the base of the triode Q2 and an upper terminal of the resistor R10, and in this case, a desired constant current can be obtained by redesigning the resistance of the resistor R9.

In some other embodiments, the attenuation circuit 12 comprises a resistor R12 and a resistor R13, wherein one terminal of the resistor R12 is connected to the integral follower circuit 11, the other terminal of the resistor R12 is connected to the modulation circuit and one terminal of the resistor R13, and the other terminal of the resistor R13 is grounded. Specifically, by configuring the first resistor R12 and the second resistor R13, a voltage signal output by the integral follower circuit can be attenuated in a certain proportion as required to match the amplitude of an oscillation signal output by the oscillation signal output circuit 30. For example, if the amplitude of the oscillation signal is 2V, the voltage divided by the resistor R12 and the resistor R13 is correspondingly attenuated to a 2V signal level in case of a maximum dimming signal input.

In some other embodiments, the integral follower circuit 11 comprises an integral circuit and a follower circuit, wherein the integral circuit comprises a resistor R11 and a capacitor C4, one terminal of the resistor R11 is connected to the dimming signal input terminal, and the other terminal of the resistor R11 is grounded through the capacitor C4; the follower circuit comprises an operational amplifier U5, an in-phase input terminal of the operational amplifier is connected to the dimming signal input terminal through the resistor R11 and is grounded through the capacitor C4, and a reverse input terminal of the operational amplifier U5 is connected to an output terminal of the operational amplifier U5. Specifically, the integral circuit of the integral follower circuit 11 consists of R11 and C4, is configured for carrying out an integral operation on a PWM dimming signal input via the dimming signal input terminal to obtain a voltage signal in direct proportion with the duty cycle of the PWM dimming signal, and is also configured for filtering an analog voltage signal input via the dimming signal input terminal. When a variable resistor is connected to the dimming signal input terminal for dimming, a voltage signal obtained by the constant current source 13 is transmitted by the circuit to the inferior level for use.

Furthermore, in some embodiments, the modulation circuit 20 comprises a PWM modulation circuit. As shown in FIG. 2, in some other embodiments, the oscillation signal output circuit 30 comprises an oscillation signal generation circuit 31 for generating a sawtooth signal and a level shift circuit 32 connected to the oscillation signal generation circuit 31 and configured for shifting the sawtooth signal to enable a low level of the sawtooth signal to be zero. Specifically, the oscillation signal generation circuit 31 generates a ramp pulse with a ramp rising linearly and a constant-amplitude and constant-frequency signal falling rapidly, namely the sawtooth signal. The level shift circuit 32 is configured for shifting the level of the sawtooth signal output by the oscillation signal generation circuit 31 to ensure that the initial point of each cycle of the pulse bottom of the sawtooth signal is the zero potential of the circuit. The PWM modulation circuit 20 is configured for inputting the normalized dimming signal processed by the input signal processing circuit 10 and processing the sawtooth signal subjected to level shifting to finally output a group of square pulse waveforms with the duty cycle in direct or reverse proportion with that of the dimming input signal.

Figure 3:
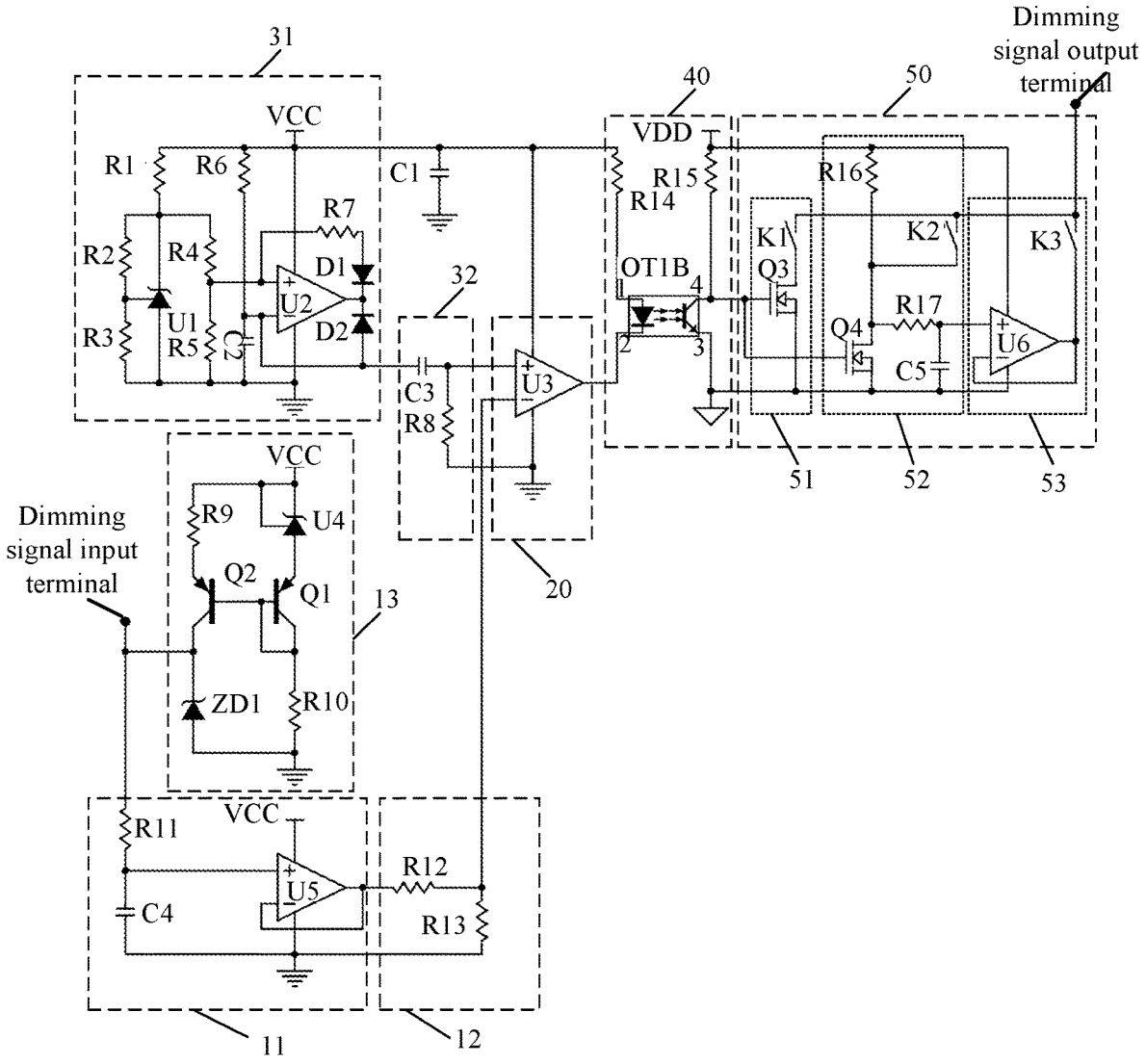
FIG. 3 is a schematic circuit diagram of one embodiment of the dimming signal processing circuit according to the invention.

Furthermore, as shown in FIG. 3, in some embodiments, the PWM modulation circuit comprises a comparator U3, wherein an in-phase input terminal of the comparator U3 is connected to the oscillation signal output circuit 30, and a reverse input terminal of the comparator U3 is connected to the input signal processing circuit 10. Specifically, a modulation signal of the PWM modulation circuit is output by the comparator U3, the sawtooth signal and the normalized dimming signal are input to the two input terminals of the comparator U3 to be compared, a group of square pulse waveforms with the duty cycle in direct or reverse proportion with that of the dimming input signal is output by the output terminal of the comparator U3, and an output waveform with the duty cycle in direct or reverse proportion with the dimming input signal can be realized by adjusting the connection relation of the two input terminals of the comparator U3.

In some other embodiments, the oscillation signal generation circuit 31 comprises a voltage reference chip U1, a comparator U2, a diode D1 and a diode D2, wherein a sampling end of the voltage reference chip U1 is connected to a cathode of the voltage reference chip U1 and is then connected to the power supply VCC through a resistor R1 and connected to the in-phase input terminal of the comparator U2 through a resistor R4, the sampling terminal of the voltage reference chip U1 is grounded through a resistor R3, and an anode of the voltage reference chip U1 is grounded; a reverse input terminal of the comparator U2 is connected to the power supply VCC through a resistor R6 and is grounded through a capacitor C2, and an in-phase input terminal of the comparator U2 is grounded through a resistor R5; a positive electrode of the diode D1 is connected to the in-phase input terminal of the comparator U2 through a resistor R7, and a negative electrode of the diode D1 is connected to an output terminal of the comparator U2; a positive electrode of the diode D2 is connected to the reverse input terminal of the comparator U2 and is also connected to the level shift circuit; a negative electrode of the diode D2 is connected to the output terminal of the comparator U2. Specifically, the resistor R2, the resistor R3, the resistor R1, and the voltage reference chip U1 constitute a precise reference voltage source, a supply voltage of the power supply VCC is divided by the resistor R4 and the resistor R5 and is then input to the in-phase input terminal of the comparator U2, the output of the comparator U2 turns when the voltage across the two terminals of the capacitor C2 gradually rises to exceed the voltage of the in-phase input terminal of the comparator U2, the capacitor C2 discharges instantly through the diode D2 until the voltage across the two terminals of the capacitor C2 is lower than the voltage of the in-phase input terminal of the comparator U2, at this moment, the comparator U24 turns again, the capacitor C2 is charged again, and these steps are repeated to finally obtain a ramp voltage across the two terminals of the capacitor C2. Because the supply voltage of the power supply VCC is constant, the resistor R6 and the capacitor C2 are fixed parameters, the time constant of the charging circuit is also a constant value. The charging curve does not rise linearly, so the resistor R4 and the resistor R7 are configured to select one segment with a good linearity of the curve as the ramp signal, and by comparison, about ⅙ of the voltage amplitude segment of the total voltage is preferably used as a ramp reference to obtain a good linearity. For example, as for a charging curve at the amplitude of 15V, the segment between 0 and 2.5V can be used as the ramp signal. In addition, the diode D1 and the diode D2 in the oscillation signal generation circuit 31 are of the same model to guarantee the symmetry, and packaged twin common-cathode diodes can be used to realize a better effect.

Furthermore, the level shift circuit 32 comprises a capacitor C3 and a resistor R8, wherein one terminal of the capacitor C3 is connected to the positive electrode of the diode D2, and the other terminal of the capacitor C3 is connected to the PWM modulation circuit; one terminal of the resistor R8 is connected to the PWM modulation circuit, and the other terminal of the resistor R8 is grounded. Specifically, the initial point of the sawtooth signal obtained by the oscillation signal generation circuit 31 may be not at the zero potential point, in this case, the sawtooth signal needs to be shifted to the zero potential by the level shift circuit 32 and is then sent to the input terminal of the PWM modulation circuit to be processed.

Furthermore, the isolation circuit 40 comprises an optocoupler OT1B, wherein a second pin of the optocoupler OT1B is connected to the output terminal of the modulation circuit 20, and a fourth pin of the optocoupler OT1B is connected to the output shaping circuit 50. Specifically, square waves output by the modulation circuit 20 drive a light-emitting tube side of the optocoupler OT1B, and an optoelectronically-isolated square signal is obtained at a phototriode side of the optocoupler OT1B.

Furthermore, as shown in FIG. 2 and FIG. 3, the plurality of signal output circuits comprise an open-drain PWM signal output 51, an amplitude-limiting PWM signal output 52, and an analog voltage signal output 53. Specifically, the dimming signal output may by any one or any combination of the open-drain PWM signal output 51, the amplitude-limiting PWM signal output 52, and the analog voltage signal output 53.

Furthermore, the open-drain PWM signal output 51 comprises an MOS transistor Q3, wherein a gate of the MOS transistor Q3 is connected to the fourth pin of the optocoupler OT1B, and a drain of the MOS transistor Q3 is connected to the dimming signal output terminal through a switch K1. The amplitude-limiting PWM signal output 52 comprises an MOS transistor Q4, wherein a gate of the MOS transistor Q4 is connected to the fourth pin of the optocoupler OT1B, and a drain of the MOS transistor Q4 is connected to power supply VDD through a resistor R16 and is connected to the dimming signal output terminal through a switch K2. The analog voltage signal output 53 comprises an operational amplifier U6, wherein an in-phase input terminal of the operational amplifier U6 is connected to the drain of the MOS transistor Q4 through a resistor R17 and is grounded through a capacitor C5, and a reverse input terminal of the operational amplifier U6 is connected to an output terminal of the operational amplifier U6 and is connected to the dimming signal output terminal through a switch K3. Specifically, an output shaping circuit 50 may comprise an MOS transistor Q3, an MOS transistor Q4, a resistor R16, a resistor R17, a capacitor C5, an operational amplifier U6 and a one-out-of-multiple switch 1, that is, K1, K2, and K3 are different channels of the one-out-of-multiple switch 1, and the square signal transmitted by the optocoupler OT1B drives the MOS transistor Q3 to realize a PWM output of the one-out-of-multiple switch 1; the square signal transmitted by the optocoupler OT1B drives the MOS transistor Q4, and the drain of the MOS transistor Q4 is connected to a power supply VDD on a secondary power supply side through a resistor R16 to realize a PWM output with an amplitude of VDD level; if the amplitude needs to be changed, the power supply voltage of the power supply VDD can be changed to limit the amplitude of different outputs; an amplitude-limiting PWM signal output by the MOS transistor Q4 is integrated by the resistor R17 and the capacitor C5 and is then buffered and output by the operational amplifier U6, so that an analog voltage signal is output; the amplitude of the analog voltage signal is a maximum VDD power supply amplitude which corresponds to a maximum dimming signal; if a more accurate amplitude signal needs to be obtained, the upper terminal of the resistor R16 is connected to a high-precision voltage stabilizing power supply rather than the power supply VDD. Herein, output signals of different dimming signals are switched to the dimming signal output terminal through a selective switch, and at each moment, only one output signal is connected to the dimming signal output terminal, that is, one of the multiple output signals is output to adapt to more application scenarios.

It should be understood that the above embodiments are merely preferred ones of the invention and are specifically described in detail, but these embodiments should not be construed as limitations of the scope of the patent for invention. It should be noted that any free combinations of the above technical features and different transformations and improvements made by those ordinarily skilled in the art without departing from the conception of the invention should also fall within the protection scope of the invention. Thus, all equivalent transformations and embellishments made within the scope of the claims of the invention should fall within the scope defined by the claims of the invention.

What is claimed is:

1. A dimming signal processing circuit having multiple functions, comprising a dimming signal input terminal and a dimming signal output terminal, characterized in that the dimming signal processing circuit further comprises an input signal processing circuit (10), a modulation circuit, an isolation circuit (40) and an output shaping circuit (50) connected in cascade to the dimming signal input terminal, and an oscillation signal output circuit (30) connected to the modulation circuit (20), wherein the output shaping circuit (50) comprises a plurality of signal output circuits connected to the dimming signal output terminal respectively.

2. The dimming signal processing circuit having multiple functions according to claim 1, characterized in that the input signal processing circuit (10) comprises an integral follower circuit (11), an attenuation circuit (12) and a constant current source (13), wherein:

the integral follower circuit (11) is connected to the dimming signal input terminal, and is configured, when a dimming signal input to the dimming signal input terminal is a PWM signal, for operating the PWM signal to obtain a first voltage signal meeting a preset condition, and is configured, when an analog DC voltage dimming signal is input to the dimming signal input terminal, for generating a third voltage signal;

the constant current source (13) is connected to the dimming signal input terminal and is configured, when the dimming signal input terminal is connected to an adjustable resistor, for generating a second voltage signal meeting the preset condition at an output terminal of the integral follower circuit (11);

the attenuation circuit (12) is connected to the integral follower circuit (11) and is configured for attenuating the first voltage signal, the second voltage signal or the third voltage signal.

3. The dimming signal processing circuit having multiple functions according to claim 2, characterized in that:

the constant current source (13) comprises a voltage reference chip U4, a triode Q2, a triode Q1, a resistor R9, a resistor R10 and zener diode ZD1, wherein a sampling terminal of the voltage reference chip U4 is connected to a cathode of the voltage reference chip U4 and is then connected to a power supply VCC, an anode of the voltage reference chip U4 is connected to an emitter of the triode Q1, a base of the triode Q1 is connected to a collector of the triode Q1 and is grounded through the resistor R10, the base of the triode Q1 is connected to a base of the triode Q2, an emitter of the triode Q2 is connected to the power supply VCC through the resistor R9, a collector of the triode Q2 is connected to the dimming signal input terminal and a negative electrode of the zener diode ZD1, and a positive electrode of the zener diode ZD1 is grounded.

4. The dimming signal processing circuit having multiple functions according to claim 2, characterized in that the integral follower circuit (11) comprises an integral circuit and a follower circuit;

the integral circuit comprises a resistor R11 and a capacitor C4, and the resistor R11 has a terminal connected to the dimming signal input terminal and another terminal being grounded through the capacitor C4;

the follower circuit comprises an operational amplifier U5, wherein an in-phase input terminal of the operational amplifier U5 is connected to the dimming signal input terminal through the resistor R11 and is grounded through the capacitor C4, and a reverse input terminal of the operational amplifier U5 is connected to an output terminal of the operational amplifier U5.

5. The dimming signal processing circuit having multiple functions according to claim 1, characterized in that the modulation circuit (20) comprises a PWM modulation circuit.

6. The dimming signal processing circuit having multiple functions according to claim 5, characterized in that:

the PWM modulation circuit comprises a comparator (U3), wherein an in-phase input terminal of the comparator (U3) is connected to the oscillation signal output circuit (30), and a reverse input terminal of the comparator (U3) is connected to the input signal processing circuit (10).

7. The dimming signal processing circuit having multiple functions according to claim 6, characterized in that the level shift circuit (32) comprises a capacitor C3 and a resistor R8;

the capacitor C3 has a terminal connected to the positive electrode of the diode D2 and another terminal connected to the PWM modulation circuit;

the resistor R8 has a terminal connected to the PWM modulation circuit and another terminal being grounded.

8. The dimming signal processing circuit having multiple functions according to claim 1, characterized in that the isolation circuit (40) comprises an optocoupler OT1B;

a second pin of the optocoupler OT1B is connected to an output terminal of the modulation circuit, and a fourth pin of the optocoupler OT1B is connected to the output shaping circuit (50).

9. The dimming signal processing circuit having multiple functions according to claim 8, characterized in that the plurality of signal output circuits comprise an open-drain PWM signal output (51), an amplitude-limiting PWM signal output (52) and an analog voltage signal output (53).

10. The dimming signal processing circuit having multiple functions according to claim 9, characterized in that:

the open-drain PWM signal output (51) comprises an MOS transistor Q3, a gate of the MOS transistor Q3 is connected to the fourth pin of the optocoupler OT1B, and a drain of the MOS transistor Q3 is connected to the dimming signal output terminal through a switch K1;

the amplitude-limiting PWM signal output (52) comprises an MOS transistor Q4, a gate of the MOS transistor Q4 is connected to the fourth pin of the optocoupler OT1B, and a drain of the MOS transistor Q4 is connected to a power supply VDD through a resistor R16 and is connected to the dimming signal output terminal through a switch K2;

the analog voltage signal output (53) comprises an operational amplifier U6, an in-phase input terminal of the operational amplifier U6 is connected to the drain of the MOS transistor Q4 through a resistor R17 and is grounded through a capacitor C5, a reverse input terminal of the operational amplifier U6 is connected to an output terminal of the operational amplifier U6 and is connected to the dimming signal output terminal through a switch K3.

11. The dimming signal processing circuit having multiple functions according to claim 2, characterized in that:

the attenuation circuit (12) comprises a resistor R12 and a resistor R13, the resistor R12 has a terminal connected to the integral follower circuit (11) and a terminal connected to the modulation circuit and one terminal of the resistor R13, and another terminal of the resistor R13 is grounded.

12. The dimming signal processing circuit having multiple functions according to claim 1, characterized in that:

the oscillation signal output circuit (30) comprises:

an oscillation signal generation circuit (31) configured for generating a sawtooth signal; and a level shift circuit (32) connected to the oscillation signal generation circuit (31) and configured for shifting the sawtooth signal to enable a low level of the sawtooth signal to be zero.

13. The dimming signal processing circuit having multiple functions according to claim 12, characterized in that:

the oscillation signal generation circuit (31) comprises a voltage reference chip U1, a comparator U2, a diode D1 and a diode D2;

a sampling terminal of the voltage reference chip U1 is connected to a cathode of the voltage reference chip U1 through a resistor R2 and is then connected to a power supply VCC through a resistor R1 and connected to an in-phase input terminal of the comparator U2 through a resistor R4, the sampling terminal of the voltage reference chip U1 is grounded through a resistor R3, and an anode of the voltage reference chip U1 is grounded;

a reverse input terminal of the comparator U2 is connected to the power supply VCC through a resistor R6 and is grounded through a capacitor C2, and the in-phase input terminal of the comparator U2 is grounded through a resistor R5;

a positive electrode of the diode D1 is connected to the in-phase input terminal of the comparator U2 through a resistor R7, and a negative electrode of the diode D1 is connected to an output terminal of the comparator U2;

a positive electrode of the diode D2 is connected to the reverse input terminal of the comparator U2 and is also connected to the level shift circuit (32), and a negative electrode of the diode D2 is connected to the output terminal of the comparator U2.

* * * * *